United States Patent [19]

Brochman

[11] 3,990,603

[45] Nov. 9, 1976

[54] EASY OPEN CLOSURE SYSTEM

[75] Inventor: Wilfred R. Brochman, Oakdale, Minn.

[73] Assignee: Minnesota Mining and Manufacturing Company, St. Paul, Minn.

[22] Filed: Dec. 9, 1975

[21] Appl. No.: 639,118

[52] U.S. Cl. ..... 220/260; 220/270; 220/359; 229/7 R; 222/485; 222/541

[51] Int. Cl.[2] ..... B65D 41/02; B65D 41/32

[58] Field of Search ..... 220/260, 270, 359; 229/7 R; 222/541, 485

[56] References Cited

UNITED STATES PATENTS

| | | | |
|---|---|---|---|
| 2,870,935 | 1/1959 | Houghtelling | 220/270 |
| 3,292,828 | 12/1966 | Stuart | 222/485 |
| 3,339,788 | 9/1967 | Lipske | 222/541 X |
| 3,389,827 | 6/1968 | Alere et al. | 220/359 |
| 3,908,857 | 9/1975 | Chiappe | 220/260 X |

*Primary Examiner*—George T. Hall
*Attorney, Agent, or Firm*—Alexander, Sell, Steldt & DeLaHunt

[57] ABSTRACT

An improved easy open closure system is described, the closure system being particularly useful for cans containing carbonated beverages. The closure system comprises an exterior tape (having specified properties) which is adhesively secured to the portion of the container surrounding a pre-formed opening, and an interior sheet material (having specified properties) which covers the underside of the opening and is adhesively secured to the exterior tape in the area of the opening.

24 Claims, 4 Drawing Figures

EASY OPEN CLOSURE SYSTEM

BACKGROUND OF THE INVENTION

This invention relates to containers having a pre-formed opening or pour hole therein covered by a removable (i.e. hand peelable) closure system. The invention also relates to end portions useful for containers adapted to package carbonated beverages.

Over the past several years there has been increasing usage of metal containers for carbonated beverages such as soft drinks and beer. The most common of these metal containers employ an easy open closure in which a metal ring attached to the end wall is lifted and pulled away in order to remove a portion of the end wall along weakened tear lines. However, such closure systems are becoming very ecologically unacceptable because the removed metal tabs, which are commonly discarded on the ground or in lakes, etc., decompose only very slowly and, due to their sharp edges, are quite dangerous in areas such as beaches where people walk barefoot.

Although it is known that unpressurized cans containing tomato juice and similar liquids can be provided with easy open closures comprising pressure sensitive adhesive tape tabs (e.g. as disclosed in U.S Pat. No. 3,389,827), such closure systems have not been acceptable for use in connection with containers in which are packaged gas-containing liquids (e.g. carbonated soft drinks and beer). Typical gas pressures for various beverages at 38° C. are as follows: orange pop, 1.7 kg/cm$^2$; strong beer, 3.3 kg/cm$^2$, root beer, ginger ale, cola, lemon, 4.5 kg/cm$^2$; club soda, 5.8 kg/cm$^2$. At room temperature the gas pressures are about 70% of these, and even under normal refrigeration (e.g. 4°–5° C.) the gas pressures are about 40% of those stated. Such gas pressures ordinarily cause prior art tape closures to bulge upward and gradually peel away from the area immediately circumjacent to the pre-formed opening (i.e. pour hole) whereby the can seal is broken.

Although U.S. Pat. Nos. 2,870,935, 3,292,828, and 3,339,788 purport to describe various easy open closure systems useful in conjunction with containers containing carbonated beverages, such systems have had only limited commercial success. A major problem encountered in the development of such closures is the difficulty of obtaining materials which have sufficient physical properties to be formed into such a seal under the conditions encountered in the filling and closing of metal containers. Furthermore, the disclosures in such patents regarding the materials which may be satisfactory for use are very general and do not provide a basis for discriminating between materials which are suitable for use in the system and those which are not.

In accordance with the present invention it has been found that of the myriads of available starting materials (in terms of films, adhesives, etc.) there are limited and select materials which are suitable in making closure systems having the proper balance of many characteristics necessary in order to be commercially acceptable.

Summary of the Invention

In accordance with the present invention there is provided an end portion for a container, wherein the end portion has a pre-formed opening (i.e. pour hole) and an easy open closure system for said opening, wherein the closure system comprises:

a. an exterior tape circumjacent (i.e. over and surrounding) said opening, said tape being peelable by hand from the exterior of said end portion surrounding said opening, said tape comprising:
   i. a flexible backing member at least 6.3 mm in width and about 25–250 microns in thickness which neither breaks nor elongates more than 25% under a tension of 4 pounds (1.8 kg.) and is capable of being pulled back upon itself without rupturing;
   ii. a uniform coating of adhesive, less than 250 microns in thickness, which adhesive coating is firmly anchored to said backing member; wherein said adhesive affords resistance to "dead load shear" of at least 17.6 p.s.i. (1.24 kg/cm$^2$) for at least 1000 minutes at 200° F. (93° C.);

wherein said exterior tape has a peel resistance within the range of about 4 to 12 pounds per inch width (0.7 to 2.1 kg. per cm. width) at temperatures from at least 35° F. to 100° F. (2° to 38° D.);

b. an interior sheet material which covers the underside of said opening and which is firmly adhered to the bottom surface of said end portion circumjacent said opening and is further adhesively secured to said exterior tape in the area of said opening, said interior sheet material comprising:
   i. a backing member of about 15 to 50 microns in thickness and having a "ppt" value in the range of about 15 to 200 grams/ply;
   ii. a layer of adhesive, having a thickness of about 3 to 50 microns, firmly adhering said backing member to said end portion, wherein said adhesive affords resistance to dead load shear of at least 17.6 p.s.i. (1.24 kg/cm$^2$) for at least 1000 minutes at 200° F. (93° C.) and has resistance to peel from the exterior tape in the area of the pre-formed opening in excess of 12 pounds per inch width (2.1 kg. per cm. width) at temperatures from at least 35° F. to 100° F. (2° to 38° C.);

wherein at least one of said exterior tape and said interior sheet material is moisture-impervious, and wherein said pre-formed opening has a pressure-relief opening associated therewith.

The invention thus provides an easy open closure system which is capable of both maintaining a seal in a pressurized container (e.g. one containing carbonated beverages such as soda or beer) and yet permitting easy and safe removal by hand (with no sharp edges to cause cuts or lacerations). The closure system imparts no undesirable tastes, flavors or odors to carbonated beverages. Further, the closure system is useful with both steel and aluminum can ends (which are the most common ends) thereby enhancing the economics of can recyclability, and the system is economically competitive with existing closure systems. Another advantage of the present closure system is that dirt and debris are not pushed into the container during opening (as contrasted with a recent development wherein portions of the can end are actually pushed into the container in order to open it). Still another advantage of the present closure system is that it is compatible with presently used canning equipment.

DETAILED DESCRIPTION OF THE INVENTION

The invention is described in more detail hereinafter with reference to the accompanying drawings wherein like reference characters refer to the same parts throughout the several views and in which.

Figure 1:
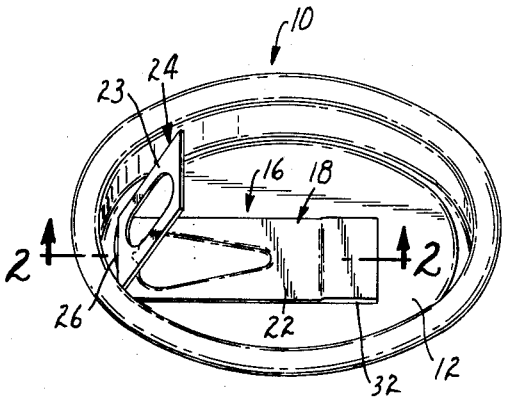
FIG. 1 is a perspective view of one embodiment of an end portion for a container in accordance with the present invention.
Figure 2:
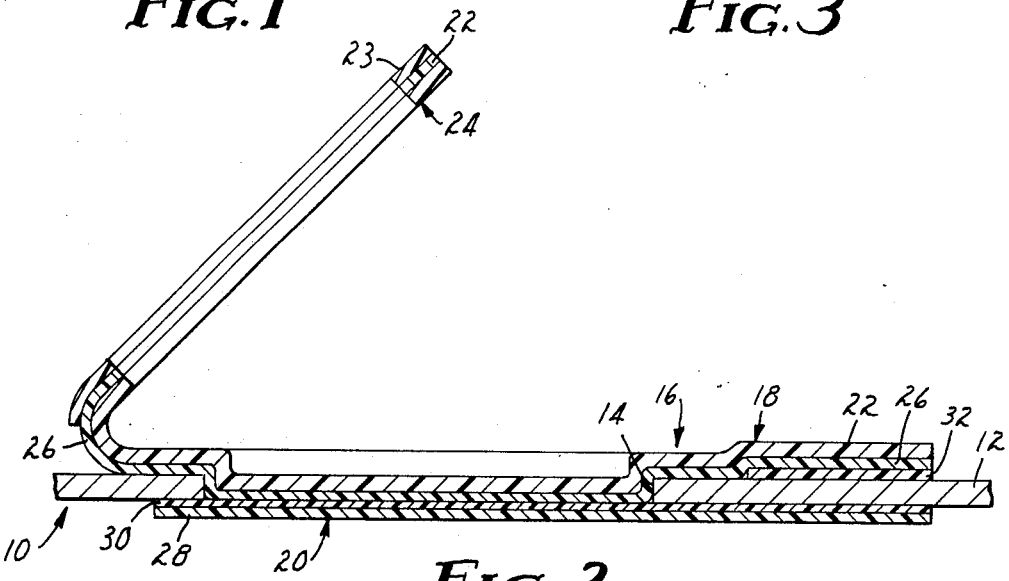
FIG. 2 is a cross-sectional view of easy open closure system on the end portion of FIG. 1.

Thus, in FIGS. 1 and 2 there is shown an end portion 10 for a container (e.g. a metal can) comprising a generally circular rigid disc or lid 12 having a pre-formed opening or pour hole 14 therein. Easy open closure system 16 comprises exterior tape 18 and interior sheet material 20.

Exterior tape 18 comprises a flexible backing member 22 which is preferably at least 6.3 mm. in width and about 25 to 250 microns in thickness. Additionally backing member 22 neither breaks nor elongates more than 25% under a tension of 4 pounds (1.8 kg.) and is capable of being pulled back upon itself without rupturing. Adhesive layer 26 is firmly anchored to backing member 22 and removably adheres backing member 22 to end portion 10 circumjacent the opening 14. Exterior tape 18 also has a tab 24 which will permit gripping by the fingers for easy removal. Tab 24 may comprise backing 22 wherein a thin, tough plastic film 23 overlays adhesive 26 and serves to reinforce backing 22 in the tab end. Tab 24 may also be a tough plastic film which is firmly secured to the end of tape 18 (e.g. by heat-sealing a film to the end of tape 18). Film 23 is preferably about 25 to 75 microns in thickness for economic reasons.

Interior sheet material 20 comprises backing member 28 which is firmly adhered to the underside of the end portion 10, circumjacent opening 14, by means of adhesive layer 30. In the area of the opening 14 the interior sheet material is adhesively secured to the exterior tape 18.

Figure 3:
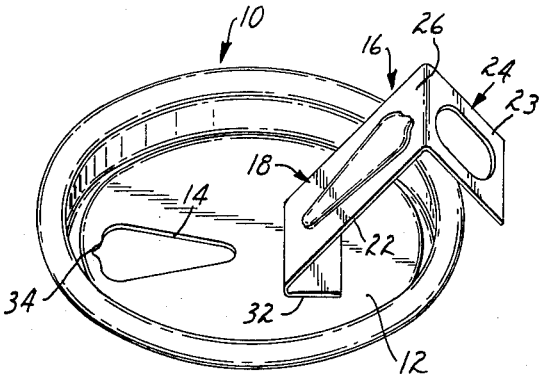
FIG. 3 is a perspective view of the closure system of FIG. 1 after being opened.

The closure system is opened by gripping the tab 24 and pulling it back across the pre-formed opening and away from the end portion 10, resulting in the opened container shown in FIG. 3. As the exterior tape is pulled back, the interior sheet material in the area of opening 14 remains adhered to exterior tape 18 and is stripped cleanly out of said opening to provide access to the contents of the container. Preferably the terminal end of exterior tape 18 has an adhesive section 32 thereon which very firmly adheres tape 18 to end portion 10 so as to discourage or prevent complete removal of tape 18 from the container by the consumer once opening 14 has been opened. Adhesive section 32 is preferably about 75 to 150 microns in thickness, and preferably is about 0.125 to 0.25 inch (0.3 to 0.6 cm.) in width, and it typically extends crosswise the entire width of exterior tape 18 as shown in the drawings.

It has been found that the advantages of the present invention are obtained only when the exterior tape and the interior sheet material possess specified physical properties. Additionally, it has also been found that the pre-formed opening should have a pressure-relief opening associated therewith so that the gas pressure differential between the inside of the container and the ambient atmosphere can be safely equalized.

Figure 4:
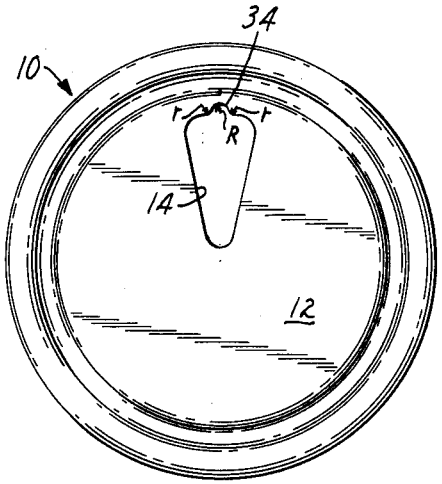
FIG. 4 is a top view of one embodiment of pre-formed opening useful in the present invention.

A preferred pressure-relief opening is as shown in FIG. 4. There the pressure-relief opening comprises protuberance 34 on the leading edge of, and contiguous with, pour hole 14. Thus, protuberance 34 is preferably a rounded projection or extension of pour hole 14. Radius R should be at least 0.6 inch (0.15 cm.), and preferably is 0.06 to 0.1 inch (0.15 to 0.25 cm.), so that there is sufficient room to permit the exterior tape 18 to be firmly adhered to interior sheet material 20 in the area of the protuberance 34. If there is insufficient adherence of the exterior tape to the interior sheet material in this area, then the interior sheet material will not be desirably removed from the protuberance when the exterior tape is stripped back. On the other hand, if radius R is too large, then the differential gas pressure is not being desirably relieved or vented over a small area. Consequently when radius R is too large, and the differential gas pressure is substantial, the pressure is relieved too quickly and violently. Radius *r* is preferably not greater than 0.08 cm. Generally speaking, the smaller the radius *r* the more likely is the possibility of the interior sheet material being prematurely ruptured or cut by the sharpness of curvature of the corner of the protuberance at that point.

The backing member 22 of exterior tape 18 should be 25–250 microns in thickness and should neither break nor elongate more than 25% under a tension of 4 pounds (1.8 kg.). At a width of ¾ inch (1.9 cm.) the backing should have a strength at break of at least 4 pounds (1.8 kg.) in order to withstand the forces exerted on it with an adequate margin of safety.

Representative materials which have been found suitable as backing members include tough plastic films which have been oriented and heat-set in manners which are well known in the art in order to impart requisite properties of toughness and heat-resistance. Suitable films include poly-1,4-butyleneterephthalate, polyethyleneterephthalate, polycarbonate, composite plastic films and soft metal such as dead-soft aluminum.

One type of particularly useful composite film comprises a layer of polyethyleneterephthalate and a layer of polyethyleneterephthalate (80)/polyethyleneisophthalate (20) copolymer, preferably prepared by co-extrusion, as taught in U.S. Pat. No. 3,871,947, incorporated herein by reference. Another type of particularly desirable composite film comprises a layer of polyethyleneterephthalate and a layer of polyethylene, the two layers being bonded together in accordance with the teachings of U.S. Pat. No. 3,188,266, incorporated herein by reference. Another useful type of composite film comprises a layer of polyethyleneterephthalate and a layer of an ethylene copolymer (e.g. ethylene(82)/ethylacrylate(18); ethylene(92)/acrylic acid (8); or ethylene (72)/vinylacetate (28)). The two layers are bonded together in accordance with the teachings of U.S. Pat. No. 3,188,266.

Those backing materials which are plastic are preferably vapor coated with a thin layer of metal (e.g. aluminum, silver, iron, etc.) to produce opacity and to improve the impermeability of the backing.

The adhesive layer 26 on exterior tape 18 is preferably less than 250 microns in thickness and is firmly anchored to backing member 22. In order to provide suitable results the adhesive must afford resistance to dead load shear of at least 17.6 p.s.i. (1.24 kg/cm$^2$) for at least 1000 minutes at 200° F. (93° C.). This shear strength is measured in the following manner: Test strips of the tape ½ × 6 inches are applied to a panel of enameled tin free steel (of the type commonly used for metal can ends) and heat sealed to said panel at 320° F. (196° C.) for 5 seconds under pressure of 40 p.s.i. (2.81 kg/cm$^2$) in a heated press. The composite is cut 0.5 inch (1.27 cm.) from the edge of the panel so that a contact area of 0.5 × 0.5 inch (1.27 cm. × 1.27 cm.) is formed. A hook is attached to the free end of the tape strip and the panel is mounted vertically in a circulating air oven at 200° F. (93° C.) for 2 minutes to reach equilibrium temperature. A 2000 gram weight is attached to the free end in such a manner as to exert its full weight in a shear force in the same plane as the 0.5 × 0.5 inch (1.27 cm. × 1.27 cm.) contact area. The 2000 gram weight on a 0.25 sq. in. (1.62 sq. cm.) sample exerts a force of 17.6 p.s.i. (1.24 kg/cm$^2$).

Furthermore, the adhesive must be of a type such that the exterior tape has a peel resistance from the end portion of a container within the range of about 4 to 12 pounds per inch width (0.7 to 2.1 kg. per cm. width) at temperatures from at least 35° F. to 100° F. (2° to 38° C.).

The specific adhesives which have been found to work include thermoplastic copolyester elastomers. These include segmented polyether esters which are high molecular weight condensation polymers derived from aromatic dicarboxylic acids, polyalkylene ether glycols, and short chain diols. The dicarboxylic acids may be, if desired, blends of acids such as terephthalic acid, isophthalic acid, etc. The polyalkylene ehter glycol is a material such as polytetramethyleneether glycol (e.g. 2000 mol. wt.). An example of a short chain diol is 1,4-butanediol. A particularly useful adhesive of the foregoing type is "Dyvax PB722" (which is available from DuPont). In this adhesive the molar ratio of acid to glycol is 1:1, and the acid is a 70/30 blend of terephthalic acid and isophthalic acid. The glycol is an 80/20 blend of 1,4-butanediol and polytetramethyleneether glycol (2000 mol. wt.). Adhesives of this type are described in U.S. Pat. No. 3,651,014, incorporated herein by reference.

These thermoplastic copolyester elastomers may be modified, if desired, by the addition thereto of tackifying resins. Useful tackifying resins may be described as hydrogenated rosin esters and terpene/urethane types which are well known, and include commercially available resins such as "Foral 105" (from Hercules Chemical) and "Isoterp 95" (from Schenectady Chemical Co.). When used, the tackifying resins are typically present in an amount of about 20 to 40% by weight of the adhesive.

The polycarbodiimide polymers useful in this invention are described in assignee's copending application Ser. No. 638,451, filed on or about Dec. 8, 1975 in the name of Thomas M. McGuire and Kenneth Peacock), incorporated herein by reference. These polycarbodiimide materials comprise organic polymers containing at least two carbodiimide groups, wherein each carbodiimide group is linked directly to an aromatic nucleus through a nitrogen atom in the carbodiimide group. The carbodiimide-containing polymers useful in the present invention must contain about 1 to about 35% by weight carbodiimide groups based on the total polymer weight. Preferably the polymer contains about 24 to about 31 weight percent carbodiimide groups and most preferably about 30 weight percent carbodiimide groups.

For convenience hereinafter the carbodiimide-containing polymers used in this present invention will be referred to as polycarbodiimide polymers although the polymers can contain substantial portions which do not contain a carbodiimide group. The portions of the polymer which are not carbodiimide groups can be any monovalent or bivalent organic radical, including monomers and polymers, and the selection of these portions of the polymer is not critical. The molecular weight of these radicals can vary within the range permitted by the required carbodiimide group concentration in the final polymer as previously described. Preferably the organic radicals in the polymer are free of substituents which react with isocyanate groups.

Preferably the polycarbodiimide polymers used herein are substantially soluble in organic solvents such as toluene, tetrahydrofurna, methylene chloride or the like so as to aid in the preferred method of applying the polycarbodiimide polymers to substrates from solution. However, the polycarbodiimide polymer in the completed, bonded structures can, when cured, be low molecular weight substantially soluble polymers or high molecular weight polymers or mixtures thereof.

A preferred class of polycarbodiimide polymers consists of carbodiimide groups linked by aromatic radicals wherein the polymers are oligomers having about 1 to 30, and most preferably about 10, repeating units and wherein the polymers are terminated with unreactive aromatic groups such as phenyl groups.

In order to assure that the adhesive layer is firmly anchored to the backing member it is sometimes necessary to use a primer. For example, when the backing member is a film of polyethyleneterephthalate, poly-1,4-butyleneterephthalate, or polycarbonate and the adhesive comprises a thermoplastic copolyester elastomer, it is necessary to use a primer (generally 60 to 300 angstroms in thickness) in order to obtain very firm anchorage of the adhesive to the film.

Useful primers, which are known in the art, include the polycarbodiimide polymers described above, a urethane (comprising the reaction product of 11.4 parts polyester diol, eq. wt. 8000, and 1.1 parts polymethylenepolyphenylisocyanate, eq. wt. 132), and phenoxy resin (comprising thermoplastic condensation product of bisphenol a and epichlorohydrin, molecular weight about 30,000, with no terminal epoxy groups — commercially available from Union Carbide as "Phenoxy PKHH").

When the backing member is one of the composite plastic films described earlier one may use the polycarbodiimide polymer as the adhesive (when applied to the layer opposite the polyethyleneterephthalate layer), with no further adhesive being necessary. For such embodiments the polycarbodiimide layer may be less than 1 micron and up to 15 microns in thickness.

When the backing member is a composite film having one layer of polyethylene, or an ethylene copolymer, over a polyethyleneterephthalate layer, then one may treat the polyethylene, or ethylene copolymer, layer with corona discharge in lieu of the use of a primer in order to obtain firm anchorage thereto of the adhesive layer.

Adhesive section 32 on exterior tape 18 is for the purpose of permanently securing tape 18 to the end portion of the container. Two specific adhesives have been found to be particularly desirable. One of these is "Dyvax PB855" (commercially available from DuPont), which is a thermoplastic copolyester elastomer comprising high molecular weight condensation polymer derived from a blend of aromatic dicarboxylic acids, polyalkyleneether glycols, and short chain diols. This particular adhesive has a melt index of 20, a Shore Hardness of 55D, tensile strength of 6400 p.s.i., an elongation at break of 700%, Tg of −80° C., total molecular weight of about 128,000.

The other particularly useful adhesive as section 32 is a phenoxy/epoxy material comprising (a) 60 parts by weight of a thermoplastic condensation product of bisphenol A and epichlorohydrin with a molecular weight of about 30,000 with no terminal epoxy groups ("Phenoxy PKHH", commercially available from Union Carbide), and (b) 40 parts by weight of a solid epoxy resin which is a condensation product of bisphenol A and epichlorohydrin ("Epon 1004," commercially available from Shell Chemical Co., softening point 95°–105° C., epoxide equivalent weight 875–1025).

The characteristics of the interior sheet material are critical to proper operation of the closure system of the invention. Functionally speaking, the interior sheet material must be capable of resisting rupture and tear propagation due to the gas pressure in a filled container while also permitting easy and complete removal thereof from the pour hole when the exterior tape is stripped away from the filled container. Thus, the interior sheet material must have properties of resisting tear and rupture when the container is filled and yet which permit easy and clean tearing around the periphery of the pour hole when tear is initiated by removal of the exterior tape.

In order for the interior sheet material to perform in the desired manner it has been found that the backing member 28 and adhesive 30 must have proper balance of several characteristics. Backing member 28 has a thickness of about 15 to 50 microns and must have a ppt value in the range of about 15 to 200 grams/ply. The ppt value is a measure of the force required to initiate a tear and to propagate such tear, and it is measured according to ASTM D-2582-67 (Reapproved 1972). When the ppt value is below 15 grams/ply the backing member is generally too weak and fragile to withstand normal processing and handling in the manufacture of a film and in the fabrication of a closure. When the ppt value is greater that about 200 grams/ply the backing member is generally too tough and initiation of tear is extremely difficult. If it is desired to use backings having a ppt value in the neighborhood of 200 grams/ply it may be desirable to perforate or score the backing member at a point adjacent the leading edge of the pour hole.

The materials which have been found suitable as backing members for the interior sheet material include plastic film such as polyethyleneterephthalate, polyvinylchloride (unplasticized), composite films comprising a layer of polyethyleneterephthalate and a layer of a polyethyleneterephthalate/polyethyleneisophthalate copolymer (with respective monomer ratios ranging from 60/40 to 80/20), and films derived from a graft copolymer comprising acrylonitrile/methylacrylate copolymer grafted onto an acrylonitrile/butadiene copolymer backbone. A particularly useful graft copolymer is formed by graft polymerizing acrylonitrile (73–77 parts by wt.) and methyl acrylate (23–27 parts by wt.) in the presence of 8 to 10 parts by wt. of an acrylonitrile/butadiene copolymer (70% by wt. derived from butadiene).

Adhesives which have been found suitable for use on the interior sheet material must afford resistance to "dead load shear" of at least 17.6 p.s.i. (1.24 kg/cm²) for at least 1000 minutes at 200° F. (93+ C.). Additionally the adhesive must have resistance to peel from the exterior tape in the area of the pour hole in excess of 12 pounds per inch width (2.1 kg. per cm. width) at temperatures from at least 35° F. to 100° F. (2° to 38° C.), and the adhesive must be firmly bonded to the underside of the container around the pour hole. Specific adhesives which are useful here include those which have been described above as being useful as the adhesive layer on the exterior tape. Additionally, in one embodiment, the interior sheet material comprises a composite plastic film in which one layer thereof serves as the backing member and the other layer thereof serves as the adhesive. This particular composite film comprises a layer of polyethyleneterephthalate (which serves as the backing member) and a layer of polyethyleneterephthalate (50–90)/polyethyleneisophthalate (10–50 )/copolymer (which serves as a heat-sealable adhesive).

Blank metal end portions for containers (e.g. cans), which have been coated with a thin lacquer or enamel coating by the can end manufacturer, are typically punched in order to provide a pour hole. Then the exterior tape and the interior sheet material of this invention are affixed circumjacent the pre-formed opening in the end portion using both heat and moderate pressure. Generally speaking, the pressure used to affix the exterior tape and interior sheet material to the can end is relatively uniform around the periphery of the pour hole and in the pour hole itself where the exterior tape is firmly bonded or secured to the interior sheet material. The pressures used are generally in the range of about 20 to 40 p.s.i. (1.4 to 2.8 kg/cm²), and the temperatures used are generally in the range of about 300° to 350° F. (150° to 175° C.). The time required, at such pressures and temperatures, to effect good bonds of the exterior tape and interior sheet material to the can end is normally not more than a few seconds (e.g. 5–10 seconds). The entire bonding operation may be done, if desired, at one time using a heated press or the like.

Other variants of this invention will be apparent to those skilled in the art.

What is claimed is:

1. An end portion for a container, said end portion having a pre-formed opening and an easy open closure system for said opening, wherein said closure systems comprises:

a. an exterior tape circumjacent said opening, said tape being peelable by hand from the exterior of said end portion surrounding said opening, said tape comprising:

i. a flexible backing member at least 6.3 mm in width and about 25–250 microns in thickness which neither breaks nor elongates more than 25% under a tension of 4 pounds (1.8 kg.) and is capable of being pulled back upon itself without rupturing;

ii. a uniform coating of adhesive, less than 250 microns in thickness, which adhesive coating is firmly anchored to said backing member; wherein said adhesive affords resistance to dead load shear of at least 17.6 p.s.i. (1.24 kg/cm²) for at least 1000 minutes at 200° F. (93° C.);

wherein said exterior tape has a peel resistance within the range of about 4 to 12 pounds per inch width (0.7 to 2.1 kg. per cm. width) at temperatures from at least 35° F. to 100° F. (2° to 38° C.);

b. an interior sheet material which covers the underside of said opening and which is firmly adhered to the bottom surface of said end portion circumjacent said opening and is further adhesively secured to said exterior tape in the area of said opening, said interior sheet material comprising:

i. a backing member of about 15 to 50 microns in thickness and having a ppt value in the range of about 15 to 200 grams/ply;

ii. a layer of adhesive, having a thickness of about 3 to 50 microns, firmly adhering said backing member to said end portion, wherein said adhesive affords resistance to dead load shear of at least 17.6 p.s.i. (1.24 kg/cm$^2$) for at least 1000 minutes at 200° F. (93° C.) and has resistance to peel from said exterior tape in said opening in excess of 12 pounds per inch width (2.1 kg. per cm. width) at temperatures from at least 35° F. to 100° F. (2° to 38° C.);

wherein at least one of said exterior tape and said interior sheet material is moisture-impervious, and wherein said pre-formed opening has a pressure-relief opening associated therewith.

2. An end portion for a container in accordance with claim 1, wherein said adhesive of said exterior tape comprises a thermoplastic copolyester elastomer consisting essentially of a multiplicity of recurring intralinear long chain and short chain ester units connected head-to-tail through ester linkages.

3. An end portion for a container in accordance with claim 2, wherein said adhesive contains about 20 to 40% by weight of a tackifying resin.

4. An end portion for a container in accordance with claim 1, wherein said flexible backing member of said exterior tape comprises a two-layered composite plastic film selected from:

a. a composite wherein the top layer comprises polyethyleneterephthalate and the bottom layer comprises a polyethyleneterephthalate polyethyleneisophthalate copolymer;

b. a composite wherein the top layer comprises polyethyleneterephthalate and the bottom layer comprises polyethylene; and c. a composite wherein the top layer comprises polyethyleneterephthalate and the bottom layer comprises an ethylene copolymer.

5. An end portion for a container in accordance with claim 1, wherein said flexible backing member of said exterior tape is selected from the group consisting of polyethyleneterephthalate, poly-1,4-butyleneterephthalate, polycarbonate, and aluminum.

6. An end portion for a container in accordance with claim 1, wherein said adhesive coating of said exterior tape is firmly anchored to said backing member by means of a primer comprising polycarbodiimide polymer.

7. An end portion in accordance with claim 1, wherein said exterior tape has a thin metallic coating thereon.

8. An end portion for a container in accordance with claim 1, wherein the backing of said interior sheet material is selected from the group consisting of polyethyleneterephthalate, polyvinylchloride, composite films of polyethyleneterephthalate and polyethyleneterephthalate/polyethyleneisophthalate copolymer and graft copolymers comprising acrylonitrile/methylacrylate copolymer grafter onto an acrylonitrile/butadiene copolymer backbone.

9. An end portion for a container in accordance with claim 1, wherein said adhesive on said interior sheet material is selected from the group consisting of a thermoplastic copolyester elastomer and a polycarbodiimide polymer.

10. An end portion for a container in accordance with claim 1, wherein said interior sheet material comprises a composite plastic film in which one layer comprises polyethyleneterephthalate and the other layer comprises a polyethyleneterephthalate/polyethyleneisophthalate copolymer, and wherein said polyethyleneterephthalate layer is said backing member and said copolymer layer is said adhesive.

11. An end portion for a container in accordance with claim 1, wherein said pressure-relief opening comprises a protuberance on the leading edge of said opening.

12. An end portion for a container in accordance with claim 1, wherein a portion of said exterior tape is permanently secured to said end portion.

13. In a container having a pre-formed opening and an easy open closure system for said opening, wherein the improvement comprises a closure system which comprises:

a. an exterior tape circumjacent said opening, said tape being peelable by hand from the exterior of said end portion surrounding said opening, said tape comprising:

i. a flexible backing member at least 6.3 mm in width and about 25–250 microns in thickness which neither breaks nor elongates more than 25% under a tension of 4 pounds (1.8 kg.) and is capable of being pulled back upon itself without rupturing;

ii. a uniform coating of adhesive, less than 250 microns in thickness, which adhesive coating is firmly anchored to said backing member; wherein said adhesive affords resistance to dead load shear of at least 17.6 p.s.i. (1.24 kg/cm$^2$) for at least 1000 minutes at 200° F. (93° C.);

wherein said exterior tape has a peel resistance within the range of about 4 to 12 pounds per inch width (0.7 to 2.1 kg. per cm. width) at temperatures from at least 35° F. to 100° F. (2° to 38° C.);

b. an interior sheet material which covers the underside of said opening and which is firmly adhered to the bottom surface of said end portion circumjacent said opening and is further adhesively secured to said exterior tape in the area of said opening, said interior sheet material comprising:

i. a backing member of about 15 to 50 microns in thickness and having a ppt value in the range of about 15 to 200 grams/ply;

ii. a layer of adhesive, having a thickness of about 3 to 50 microns, firmly adhering said backing member to said end portion, wherein said adhesive affords resistance to dead load shear of at least 17.6 p.s.i. (1.24 kg/cm$^2$) for at least 1000 minutes at 200° F. (93° C.) and has resistance to peel from said exterior tape in said opening in excess of 12 pounds per inch width (2.1 kg. per cm. width) at temperatures from at least 35° F. to 100° F. (2° to 38° C.);

wherein at least one of said exterior tape and said interior sheet material is moisture-impervious, and wherein said pre-formed opening has a pressure-relief opening associated therewith.

14. A container in accordance with claim 13, wherein said adhesive of said exterior tape comprises a thermoplastic copolyester elastomer consisting essentially of a multiplicity of recurring intralinear long chain and short chain ester units connected head-to-tail through ester linkages.

15. A container in accordance with claim 14, wherein said adhesive contains about 20 to 40% by weight of a tackifying resin.

16. A container in accordance with claim 13, wherein said flexible backing member of said exterior tape comprises a two-layered composite plastic film selected from:

a. a composite wherein the top layer comprises polyethyleneterephthalate and the bottom layer comprises a polyethyleneterephthalate polyethyleneisophthalate copolymer;

b. a composite wherein the top layer comprises polyethyleneterephthalate and the bottom layer comprises polyethylene; and c. a composite wherein the top layer comprises polyethyleneterephthalate and the bottom layer comprises an ethylene copolymer.

17. A container in accordance with claim 13, wherein said flexible backing member of said exterior tape is selected from the group consisting of polyethyleneterephthalate, poly-1,4-butyleneterephthalate, polycarbonate, and aluminum.

18. A container in accordance with claim 13, wherein said adhesive coating of said exterior tape is firmly anchored to said backing member by means of a primer comprising polycarbodiimide polymer.

19. A container in accordance with claim 13, wherein said exterior tape has a thin metallic coating thereon.

20. A container in accordance with claim 13, wherein the backing of said interior sheet material is selected from the group consisting of polyethyleneterephthalate, polyvinylchloride, composite films of polyethyleneterephthalate and polyethyleneterephthalate/polyethyleneisophthalate copolymer and graft copolymers comprising acrylonitrile/methylacrylate copolymer grafted onto an acrylonitrile/-butadiene copolymer backbone.

21. A container in accordance with claim 13, wherein said adhesive on said interior sheet material is selected from the group consisting of a thermoplastic copolyester elastomer and a polycarbodiimide polymer.

22. A container in accordance with claim 13, wherein said interior sheet material comprises a composite plastic film in which one layer comprises polyethyleneterephthalate and the other layer comprises a polyethyleneterephthalate/polyethyleneisophthalate copolymer, and wherein said polyethyleneterephthalate layer is said backing member and said copolymer layer is said adhesive.

23. A container in accordance with claim 13, wherein said pressure-relief opening comprises a protuberance on the leading edge of said opening.

24. A container in accordance with claim 13, wherein a portion of said exterior tape is permanently secured to said end portion.

* * * * *

UNITED STATES PATENT AND TRADEMARK OFFICE

CERTIFICATE OF CORRECTION

PATENT NO. : 3,990,603

DATED : November 9, 1976

INVENTOR(S) : Wilfred R. Brochman

It is certified that error appears in the above-identified patent and that said Letters Patent are hereby corrected as shown below:

ol. 2, line 20, "38°D." should read -- 38°C. -- .

ol. 6, line 40, "bisphenol a" should read -- bisphenol A -- .

Col. 7, line 41, "that" should read -- than -- .

Col. 7, line 67, "93+C." should read -- 93°C. -- .

Col. 9, line 65, "grafter" should read -- grafted -- .

Signed and Sealed this

Twenty-second Day of March 1977

[SEAL]

*Attest:*

RUTH C. MASON
*Attesting Officer*

C. MARSHALL DANN
*Commissioner of Patents and Trademarks*